US008673830B2

(12) United States Patent
Fujinami et al.

(10) Patent No.: US 8,673,830 B2
(45) Date of Patent: Mar. 18, 2014

(54) GREASE COMPOSITION AND DIRECT-ACTING DEVICES WITH THE GREASE COMPOSITION

(75) Inventors: Yukitoshi Fujinami, Ichihara (JP); Shigeo Hara, Ichihara (JP); Hiroyuki Kitano, Chiyoda-ku (JP); Kensaku Fujinaka, Nagaokakyo (JP); Hironori Yoshimura, Nagaokakyo (JP); Yasushi Ohara, Nagaokakyo (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 572 days.

(21) Appl. No.: 12/937,346

(22) PCT Filed: Apr. 7, 2009

(86) PCT No.: PCT/JP2009/057147

§ 371 (c)(1),
(2), (4) Date: Oct. 11, 2010

(87) PCT Pub. No.: WO2009/125775

PCT Pub. Date: Oct. 15, 2009

(65) Prior Publication Data

US 2011/0041638 A1 Feb. 24, 2011

(30) Foreign Application Priority Data

Apr. 11, 2008 (JP) ..... 2008-103931

(51) Int. Cl.

| | |
|---|---|
| ***C10M 169/04*** | (2006.01) |
| ***F16H 3/06*** | (2006.01) |
| ***F16H 27/02*** | (2006.01) |
| ***F16H 29/02*** | (2006.01) |
| ***F16H 29/20*** | (2006.01) |

(52) U.S. Cl.
USPC ..... 508/110; 74/89.39

(58) Field of Classification Search
USPC ..... 74/424.82, 89.39; 508/110, 485, 487
See application file for complete search history.

(56) References Cited

U.S. PATENT DOCUMENTS 2,545,190 A * 3/1951 Bondi ..... 508/520
3,242,075 A * 3/1966 Hunter ..... 427/388.1

(Continued)

FOREIGN PATENT DOCUMENTS

CN 1052891 A 7/1991
CN 1356381 A 7/2002

(Continued)

OTHER PUBLICATIONS

Machine Translation of JP2002-340132. Nov. 2002.*

(Continued)

*Primary Examiner* — Justin Krause
(74) *Attorney, Agent, or Firm* — Oblon, Spivak, McClelland, Maier & Neustadt, L.L.P.

(57) ABSTRACT

A grease composition includes: a poly-α-olefin having a kinematic viscosity at 40 degrees C. of 60 to 320 $mm^2/s$, the poly-α-olefin being contained in an amount of 50 mass % or more relative to a whole composition; a thickener that is a lithium salt of a hydroxyl-free fatty acid having 10 to 22 carbon atoms; and an ashless dithiocarbamate and/or zinc dithiocarbamate that are contained in an amount of 0.1 to 1.5 mass % in terms of sulfur relative to a whole composition. In the grease composition, a phosphorous content is 0.05 mass % or less relative to the whole composition, and a worked penetration is in a range from 265 to 310.

20 Claims, 2 Drawing Sheets

(56) References Cited

U.S. PATENT DOCUMENTS

| | | | | |
|---|---|---|---|---|
| 6,339,049 | B1 | 1/2002 | Funahashi et al. | |
| 6,352,961 | B1 * | 3/2002 | Iso et al. | 508/155 |
| 7,347,115 | B2 * | 3/2008 | Otaki et al. | 74/89.38 |
| 2002/0002119 | A1 | 1/2002 | Naka et al. | |
| 2002/0013232 | A1 | 1/2002 | Kinoshita et al. | |
| 2002/0183213 | A1 * | 12/2002 | Komiya et al. | 508/485 |
| 2005/0261141 | A1 | 11/2005 | Iso et al. | |

FOREIGN PATENT DOCUMENTS

| | | | | |
|---|---|---|---|---|
| CN | 1973149 | A | | 5/2007 |
| JP | 5 9489 | | | 1/1993 |
| JP | 8 143884 | | | 6/1996 |
| JP | 8 270747 | | | 10/1996 |
| JP | 11 166191 | | | 6/1999 |
| JP | 2000 192973 | | | 7/2000 |
| JP | 2000 230616 | | | 8/2000 |
| JP | 2000 303089 | | | 10/2000 |
| JP | 2001 59094 | | | 3/2001 |
| JP | 2001 139975 | | | 5/2001 |
| JP | 2001 152175 | | | 6/2001 |
| JP | 2001 226688 | | | 8/2001 |
| JP | 2002340132 | A | * | 11/2002 |
| JP | 2003 232373 | | | 8/2003 |
| JP | 2004 352953 | | | 12/2004 |
| JP | 2005 86932 | | | 3/2005 |
| JP | 2005 88199 | | | 4/2005 |
| JP | 2005 106103 | | | 4/2005 |
| JP | 2005 180602 | | | 7/2005 |
| JP | 2005 272764 | | | 10/2005 |
| JP | 2005 344740 | | | 12/2005 |
| JP | 2006 132638 | | | 5/2006 |
| JP | 2006 250289 | | | 9/2006 |
| JP | 2007 50761 | | | 3/2007 |
| JP | 2007 78110 | | | 3/2007 |
| JP | 2007 89374 | | | 4/2007 |
| WO | WO 2005/124188 | A1 | | 12/2005 |

OTHER PUBLICATIONS

International Search Report issued Jun. 16, 2009 in PCT/JP09/57147 filed Apr. 7, 2009.

Combined Office Action and Search Report issued Mar. 5, 2013 in Chinese Patent Application No. 200980112856.5 with English translation and English translation of categories of cited documents.

Chinese Office Action issued Oct. 10, 2012, in China Patent Application No. 200980112856.5 (with partial English translation).

* cited by examiner

GREASE COMPOSITION AND DIRECT-ACTING DEVICES WITH THE GREASE COMPOSITION

TECHNICAL FIELD

The present invention relates to a grease composition. Specifically, the present invention relates to a grease composition to be used for a linear motion machine in a clean environment.

BACKGROUND ART

Grease is used for lubricating a gear, a bearing and the like in order to prevent friction to improve a driving efficiency and mechanical life thereof. However, in a field requiring a clean environment such as a clean room, precision machine production, semiconductor production, flat display production and food manufacturing, fine particles (for instance, an average diameter of 5 μm or less) that are generated from grease influences a production yield (hereinafter, generation of dust from grease is referred to as "dust generation"). Accordingly, such dust generation needs to be suppressed as much as possible.

Accordingly, for such an application, a so-called "low dust-generation grease," which suppresses dust generation, has been proposed. For instance, there has been proposed a grease composition containing 10 to 35 mass % of a lithium stearate soap as a thickener and 0.5 to 15.0 mass % of one or more compositions selected from the group consisting of oxidized paraffin and diphenyl hydrogen phosphite (see Patent Document 1). Moreover, there has been proposed another grease composition containing 15 to 30 mass % relative to a whole composition of a lithium salt of a hydroxyl-free fatty acid having 10 or more carbon atoms, the lithium salt being formed in a fiber shape with a length and a diameter of 2 μm or less respectively (see Patent Document 2).

CITATION LIST

Patent Literature

Patent Document 1 JP-A-2001-139975
Patent Document 2 JP-A-2004-352953

SUMMARY OF THE INVENTION

Problems to Be Solved by the Invention

However, the grease compositions disclosed in Patent Documents 1 and 2, although dust generation therefrom is suppressed to some extent, lack load resistance (extreme pressure property) and cannot thus exhibit lubricity enough for a high-load application. Addition of ZnDTP and a sulfur/phosphorous extreme pressure agent, which are typical load resistant additives, adversely affects dust generation. For this reason, it is difficult to apply these grease compositions to a linear motion machine used for a clean room particularly requiring a low dust-generation and a lubricity.

An object of the invention is to provide a grease composition exhibiting an excellent lubricity and a low dust-generation under a high load, and a linear motion machine with use of the grease composition.

Means for Solving the Problems

In order to solve the above problem, the invention provides a grease composition and a linear motion machine with use of the grease composition as described below.

(1) A grease composition according to an aspect of the invention, including: a poly-α-olefin having a kinematic viscosity at 40 degrees C. of 60 to 320 $mm^2/s$, the poly-α-olefin being contained in an amount of 50 mass % or more relative to a whole composition; a thickener that is a lithium salt of a hydroxyl-free fatty acid having 10 to 22 carbon atoms; and an ashless dithiocarbamate and/or zinc dithiocarbamate that are contained in an amount of 0.1 to 1.5 mass % in terms of sulfur relative to the whole composition, in which a phosphorous content in the grease composition is 0.05 mass % or less relative to the whole composition, and a worked penetration is in a range from 265 to 310.

(2) The grease composition according to the above aspect of the invention, in which the lithium salt of the fatty acid is lithium stearate.

(3) The grease composition according to the above aspect of the invention, in which the poly-α-olefin is a linear olefin oligomer.

(4) The grease composition according to the above aspect of the invention, in which the composition is used for a linear motion machine in a clean environment.

(5) The grease composition according to the above aspect of the invention, in which the linear motion machine is provided with a rolling device including a ball screw as a mechanical element, and the composition is used for the rolling device including the ball screw.

(6) The grease composition according to the above aspect of the invention, in which the linear motion machine has a deceleration mechanism by a gear, and the composition is used for the gear.

(7) A linear motion machine with use of the grease composition according to the aspect of the invention.

According to the above aspect of the invention, since the grease composition exhibits an excellent lubricity and a low dust-generation even under a high load, the grease composition can be favorably used for, particularly, the linear motion machine for the clean room.

DESCRIPTION OF EMBODIMENTS

Figure 1:
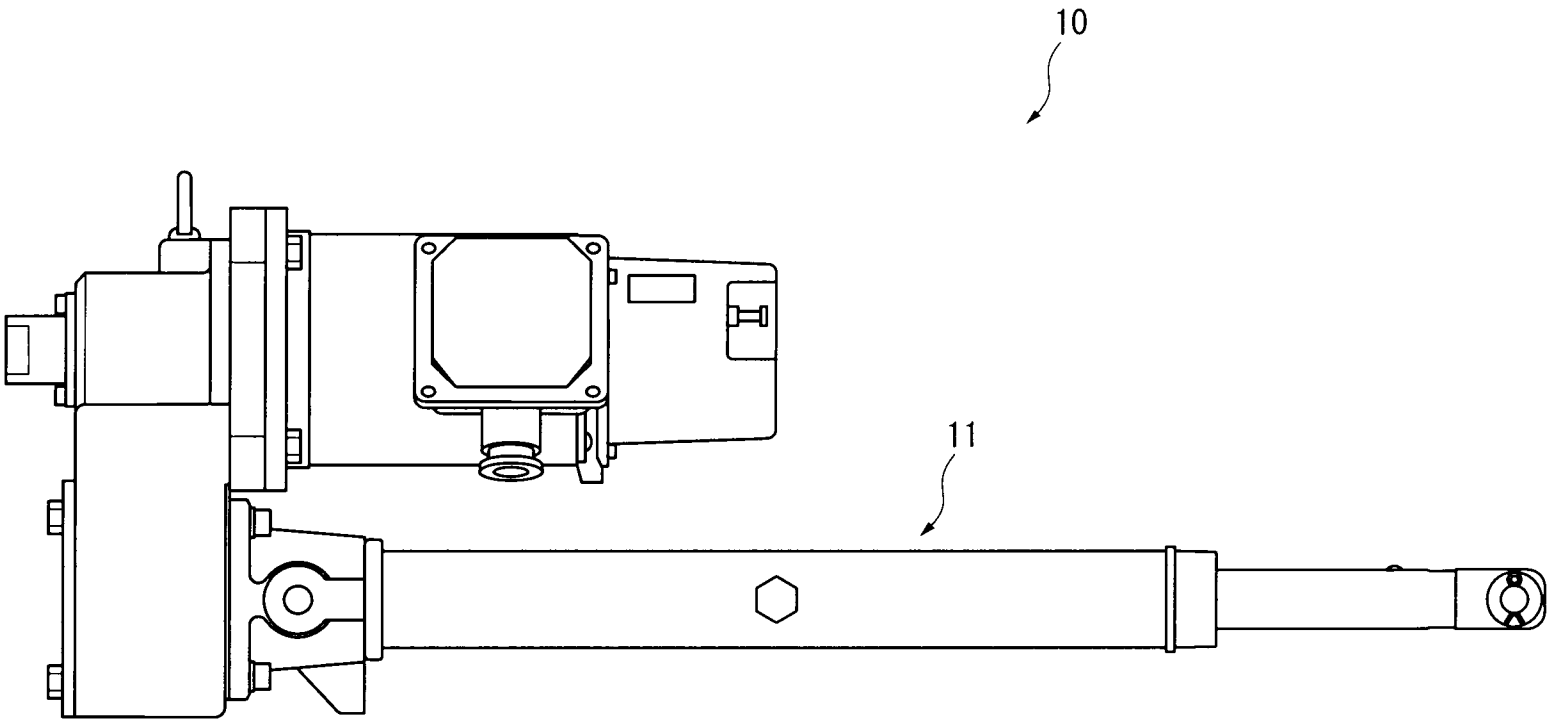
FIG. 1 shows an outline of an electrical cylinder according to an example of the invention.

Best mode for carrying out the invention will be described in detail below.

The grease composition according to an exemplary embodiment (hereinafter, also referred to as "the composition") contains a poly-α-olefin and a thickener.

Any poly-α-olefins used in a field of a lubricating oil are applicable for the invention. It should be noted that a kinematic viscosity at 40 degrees C. of the poly-α-olefin needs to be 60 to 320 $mm^2/s$, preferably 70 to 200 $mm^2/s$. When the kinematic viscosity at 40 degrees C. is less than 60 $mm^2/s$, load resistance is lowered. On the other hand, when the kinematic viscosity at 40 degrees C. exceeds 320 $mm^2/s$, wear resistance is lowered and fretting wear may be particularly increased.

The poly-α-olefin corresponds to a base oil in the composition. The poly-α-olefin exhibits a high viscosity index in addition to a low dust generation. Accordingly, when the poly-α-olefin is used as the base oil, viscosity change of the composition due to temperature change is small, so that properties of the composition are less changeable for a broad temperature range. Accordingly, the poly-α-olefin needs to be contained in an amount of 50 mass % or more relative to the whole composition, preferably 60 mass % or more, more preferably 70 mass % or more, further preferably 80 mass % or more, most preferably 90 mass % or more. When the amount of the poly-α-olefin is less than 50 mass %, features of the poly-α-olefin are impaired.

A predetermined poly-α-olefin may be contained in the above amount as the base oil. As long as advantages of the invention are not impaired, other synthetic oils and mineral oils may be further contained. Examples of such synthetic oils, as which various known synthetic oils are usable, include: polybutene, polyol ester, diacid ester, phosphate ester, polyphenyl ether, alkylbenzene, alkylnaphthalene, polyoxyalkyleneglycol, neopentylglycol, silicone oil, trimethylolpropane, pentaerythritol, and hindered ester. Examples of such mineral oils, as which various known mineral oils are usable, include: a paraffinic mineral oil, an intermediate mineral oil and a naphthenic mineral oil. Specifically, the examples of the mineral oils include: a light neutral oil, an intermediate neutral oil, heavy neutral oil or bright stock by solvent purification or hydrogen purification.

The synthetic oil and the base oil preferably exhibit a kinematic viscosity at 40 degrees C. in the same range as that of the poly-α-olefin.

The thickener contained in the composition is the lithium salt of the hydroxyl-free fatty acid having 10 to 22 carbon atoms.

When the lithium salt of the fatty acid has a hydroxyl group, the amount of dust generation is inconveniently increased. When the lithium salt of the fatty acid has 9 or less carbon atoms, a thickening effect of the composition is decreased, so that it is difficult for the composition to become grease. On the other hand, when the lithium salt of the fatty acid has 23 or more carbon atoms, the composition is difficult to be produced and available, which is unfavorably unpractical as an industrial product. Accordingly, the number of carbon atoms of the lithium salt of the fatty acid is preferably in a range of 14 to 20.

As such the lithium salt of the fatty acid, a lithium salt of a fatty acid mainly including lithium stearate is the most preferable in view of a high thickening effect and an excellent thermal resistance.

The composition contains at least one of an ashless dithiocarbamate and zinc dithiocarbamate in an amount of 0.1 to 1.5 mass % in terms of sulfur (relative to the whole composition), as the extreme pressure agent.

Examples of the ashless dithiocarbamate include: methylenebisdiethyldithiocarbamate, methylenebisdibutyldithiocarbamate, methylenebisdiamyldithiocarbamate, methylenebisdiaryldithiocarbamate, and a thiocarbamate derivative.

Examples of zinc dithiocarbamate include: zinc diamyldithiocarbamate, zinc diaryldithiocarbamate, zinc oxysulfide dithiocarbamate, and zinc sulfide dithiocarbamate. Particularly, zinc diamyldithiocarbamate, which is widely commercially-available and easily obtainable, is preferable.

These compounds may be used singularly or in a combination of two or more thereof.

When the at least one of the ashless dithiocarbamate and zinc dithiocarbamate is contained in the amount of less than 0.1 mass % in terms of sulfur, a sufficient load resistance of the composition cannot be obtained. On the other hand, when the at least one of the ashless dithiocarbamate and zinc dithiocarbamate is contained in the amount of more than 1.5 mass %, thermal cure is likely to occur, thereby shortening a lifetime of the grease composition. The contained amount of the at least one of the ashless dithiocarbamate and zinc dithiocarbamate is more preferably in a range of 0.3 to 1.0 mass % in terms of sulfur, further preferably in a range of 0.3 to 0.7 mass %.

In the composition, an amount of phosphorous is 0.05 mass % or less relative to the whole composition, preferably 0.03 mass % or less.

When the amount of phosphorous in the composition exceeds 0.05 mass % relative to the whole composition, dust generation may be increased. Accordingly, it is not preferable to add ZnDTP, a sulfur/phosphorous extreme pressure agent, or a phosphorous-containing extreme pressure agent such as TCP. In case of addition thereof, an amount thereof should be the required minimum.

A worked penetration of the composition is in a range of 265 to 310 (according to JIS (Japanese Industrial Standard) K2220.7). When the worked penetration is less than 265, the grease composition is "too hard," thereby lowering wear resistance, particularly increasing fretting wear. On the other hand, when the worked penetration is more than 310, the grease composition is "too soft," thereby increasing dust generation.

Since the grease composition with the above arrangement exhibits the excellent lubricity and the low dust generation, the grease composition is preferable for a low dust-generation rolling device (a device for carrying out a rolling movement (e.g. a rolling bearing, ball screw and linear guide)). For instance, the grease composition is preferably usable for the linear motion machine for the clean room such as an electrical cylinder, electrical linear actuator, jack and linear operating machine. Particularly, in a high-load application, the grease composition is effective on the linear motion machine including the ball screw as a mechanical element. Further, the grease composition is also effective on the linear motion machine including a deceleration mechanism by a gear.

In the grease composition of the invention, additives such as an antioxidant, rust inhibitor, solid lubricant, filler, oiliness agent, metal deactivator may be added as needed in a range where the object of the invention is achieved.

Examples of the antioxidant include: an amine antioxidant such as alkylated diphenylamine, phenyl-α-naphthylamine and alkylated-α-naphthylamine; and a phenol antioxidant such as 2,6-di-t-butyl-4-methylphenol and 4,4'-methylenebis (2,6-di-t-butylphenol). These antioxidants are typically used in a ratio of 0.05 to 2 mass %.

Examples of the rust inhibitor include: sodium nitrite, petroleum sulphonate, sorbitan monooleate, fatty acid soap and an amine compound.

Examples of the solid lubricant include: polyimide, PTFE, graphite, metal oxide, boron nitride, melamine cyanurate (MCA) and molybdenum disulfide. A single one of the above additives may be contained or several of which may be contained in combination. The lubricating additive of the invention does not hamper the above effects.

EXAMPLES

Next, the invention will be explained in further detail with reference to Examples and Comparative Examples, but the invention is not limited thereto.

Examples 1-7, Comparative Examples 1-13

Production of Grease Composition

Grease compositions of Examples and Comparative Examples were respectively produced as described below. Blending ratios of the respective grease compositions are shown in Tables 1 to 3.

Examples 1-7, Comparative Examples 1-5, Comparative Examples 8-13

(1) A portion of a base oil (50 mass % of a finished grease amount) and a stearic acid, whose blending ratios are shown in Tables, were heated to be dissolved while being stirred in a reaction vessel.
(2) Next, lithium hydroxide (monohydrate) shown in Tables was diluted by five times, then added to the composition (1) and mixed while being heated.
(3) After the temperature of a grease composition reached 200 degrees C., the grease composition was kept for five minutes.
(4) Next, after the rest of the base oil was added thereto, the grease composition was cooled down to 80 degrees C. at a speed of 50 degrees C./hour. As shown in Tables, an antioxidant, an anticorrosive and an extreme pressure agent were added thereto to be mixed.
(5) Further, after the grease composition was naturally cooled down to a room temperature, a milling treatment was applied thereto to obtain a grease composition having a worked penetration shown in Tables.

Comparative Example 6

(1) A half of a base oil having a blending ratio shown in Tables and diphenylmethane-4,4'-diisocyanate (4.1 mass % of the whole composition) were heated at 60 to 70 degrees C. to be dissolved while being stirred in a reaction vessel.
(2) Laurylamine (6.0 mass % of the whole composition) was dissolved in the rest of the base oil, and then added to the composition (1) and heated to be mixed.
(3) After the temperature of a grease composition reached 160 degrees C., the grease composition is kept for 60 minutes.
(4) The grease composition was cooled down to 80 degrees C. at a speed of 50 degrees C./hour. As shown in Tables, an antioxidant, an anticorrosive and an extreme pressure agent were added thereto to be mixed.
(5) Further, after the grease composition was naturally cooled down to a room temperature, a milling treatment was applied theretot to obtain a grease composition having a worked penetration shown in Tables.

Comparative Example 7

A grease composition was produced by the same method except the stearic acid in Example 1 was changed to 12-hydroxystearic acid.

TABLE 1

| | | | Example 1 | Example 2 | Example 3 | Example 4 | Example 5 | Example 6 | Example 7 |
|---|---|---|---|---|---|---|---|---|---|
| blending ratio (mass %) | base oil | PAO-A (※1) | — | — | — | — | — | — | — |
| | | PAO-B (※2) | 50.0 | 62.6 | 49.9 | 50.7 | 36.6 | 50.0 | 50.0 |
| | | PAO-C (※3) | 20.6 | 8.0 | 20.6 | 20.9 | 34.0 | 20.6 | 20.6 |
| | | ester (※4) | — | — | — | — | — | — | — |
| | thickener | stearic acid (※5) | 22.0 | 22.0 | 22.0 | 22.0 | 22.0 | 22.0 | 22.0 |
| | | 12-hydroxystearic acid | — | — | — | — | — | — | — |
| | | caprylic acid (C8-fatty acid) | — | — | — | — | — | — | — |
| | | lauric acid (C12-fatty acid) | — | — | — | — | — | — | — |
| | | lithium hydroxide(monohydrate) | 3.4 | 3.4 | 3.4 | 3.4 | 3.4 | 3.4 | 3.4 |
| | | urea (※6) | — | — | — | — | — | — | — |
| | antioxidant | octyldiphenylamine | 0.5 | 0.5 | 0.5 | 0.5 | 0.5 | 0.5 | 0.5 |
| | anticorrosive | Ca sulfonate | 0.5 | 0.5 | 0.5 | 0.5 | 0.5 | 0.5 | 0.5 |
| | extreme pressure agent | ZnDTC (※7) | 3.0 | 3.0 | 3.0 | — | 3.0 | 3.0 | 3.0 |
| | | ashless DTC (※8) | — | — | — | 2.0 | — | — | — |
| | | ZnDTP (※9) | — | — | — | — | — | — | — |
| | | sulfur-phosphorous (※10) | — | — | — | — | — | — | — |
| | | alkyl acid phosphate | — | — | — | — | — | — | — |
| | | tricresyl phosphate | — | — | 0.1 | — | — | — | — |
| | | Total | 100.0 | 100.0 | 100.0 | 100.0 | 100.0 | 100.0 | 100.0 |
| kinematic viscosity at 40° C. of base oil ($mm^2/s$) | | | 100 | 75.0 | 100 | 100 | 140 | 100 | 100 |
| grease properties | | worked penetration | 291 | 291 | 289 | 290 | 291 | 279 | 301 |
| | | sulfur content (mass %) | 0.38 | 0.38 | 0.38 | 0.63 | 0.38 | 0.38 | 0.38 |
| | | sulfur content from extreme pressure agent (mass %) | 0.37 | 0.37 | 0.37 | 0.61 | 0.37 | 0.37 | 0.37 |
| | | phosphorous content (mass %) | 0.000 | 0.000 | 0.008 | 0.000 | 0.000 | 0.000 | 0.000 |
| load resistance | | high speed four-ball test (weld load) (N) | 1961 | 1961 | 1961 | 1961 | 1961 | 1961 | 1961 |
| dust generation property | | dust generation test (piece/10 L) | 209 | 182 | 305 | 242 | 188 | 178 | 317 |
| fretting property | | fretting wear protection test (mg) | 24 | 19 | 23 | 23 | 24 | 32 | 24 |

TABLE 2

| | | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|
| blending ratio (mass %) | base oil | PAO-A (※1) | — | — | — | — | 70.6 | — | — |
| | | PAO-B (※2) | 51.8 | 46.3 | 51.1 | — | — | 60.9 | 59.0 |
| | | PAO-C (※3) | 21.3 | 19.1 | 21.0 | 70.6 | — | 25.0 | 24.3 |
| | | ester (※4) | — | — | — | — | — | — | — |
| | thickener | stearic acid (※5) | 22.0 | 26.5 | 20.7 | 22.0 | 22.0 | — | — |
| | | 12-hydroxystearic acid | — | — | — | — | — | — | 11 |
| | | caprylic acid (C8-fatty acid) | — | — | — | — | — | — | — |
| | | lauric acid (C12-fatty acid) | — | — | — | — | — | — | — |
| | | lithium hydroxide(monohydrate) | 3.4 | 4.1 | 3.2 | 3.4 | 3.4 | — | 1.65 |
| | | urea (※6) | — | — | — | — | — | 10.1 | — |
| | antioxidant | octyldiphenylamine | 0.5 | 0.5 | 0.5 | 0.5 | 0.5 | 0.5 | 0.5 |
| | anticorrosive | Ca sulfonate | 0.5 | 0.5 | 0.5 | 0.5 | 0.5 | 0.5 | 0.5 |
| | extreme pressure agent | ZnDTC (※7) | 0.5 | 3.0 | 3.0 | 3.0 | 3.0 | 3.0 | 3.0 |
| | | ashless DTC (※8) | — | — | — | — | — | — | — |
| | | ZnDTP (※9) | — | — | — | — | — | — | — |
| | | sulfur-phosphorous (※10) | — | — | — | — | — | — | — |
| | | alkyl acid phosphate | — | — | — | — | — | — | — |
| | | tricresyl phosphate | — | — | — | — | — | — | — |
| | | Total | 100.0 | 100.0 | 100.0 | 100.0 | 100.0 | 100.0 | 100.0 |
| kinematic viscosity at 40° C. of base oil ($mm^2/s$) | | | 100 | 100 | 100 | 396 | 28.8 | 100 | 100 |
| grease properties | | worked penetration | 288 | 229 | 332 | 290 | 290 | 287 | 292 |
| | | sulfur content (mass %) | 0.08 | 0.38 | 0.38 | 0.38 | 0.38 | 0.38 | 0.38 |
| | | sulfur content from extreme pressure agent (mass %) | 0.06 | 0.37 | 0.37 | 0.37 | 0.37 | 0.37 | 0.37 |
| | | phosphorous content (mass %) | 0.000 | 0.000 | 0.000 | 0.000 | 0.000 | 0.000 | 0.000 |
| load resistance | | high speed four-ball test (weld load) (N) | 1569 | 1961 | 1961 | 1961 | 1569 | 1961 | 1961 |
| dust generation | | dust generation test (piece/10 L) | 154 | 147 | 2187 | 224 | 219 | 2444 | 1626 |
| fretting property | | fretting wear protection test (mg) | 58 | 68 | 8.9 | 70 | 22 | 21 | 33 |

TABLE 3

| | | | Comparative Example 8 | Comparative Example 9 | Comparative Example 10 | Comparative Example 11 | Comparative Example 12 | Comparative Example 13 |
|---|---|---|---|---|---|---|---|---|
| blending ratio (mass %) | base oil | PAO-A (※1) | — | — | — | — | — | — |
| | | PAO-B (※2) | 50.4 | 50.0 | 49.8 | 50.7 | 49.3 | — |
| | | PAO-C (※3) | 20.7 | 20.6 | 20.5 | 20.9 | 20.3 | — |
| | | ester (※4) | — | — | — | — | — | 69.9 |
| | thickener | stearic acid (※5) | 22.0 | 22.0 | 24.0 | 22.0 | 22.0 | 22.6 |
| | | 12-hydroxystearic acid | — | — | — | — | — | — |
| | | caprylic acid (C8-fatty acid) | — | — | — | — | — | — |
| | | lauric acid (C12-fatty acid) | — | — | — | — | — | — |
| | | lithium hydroxide(monohydrate) | 3.4 | 3.4 | 3.7 | 3.4 | 3.4 | 3.5 |
| | | urea (※6) | — | — | — | — | — | — |
| | antioxidant | octyldiphenylamine | 0.5 | 0.5 | 0.5 | 0.5 | 0.5 | 0.5 |
| | anticorrosive | Ca sulfonate | 0.5 | 0.5 | 0.5 | 0.5 | 0.5 | 0.5 |
| | extreme pressure agent | ZnDTC (※7) | — | — | — | — | 3.0 | 3.0 |
| | | ashless DTC (※8) | — | — | — | — | — | — |
| | | ZnDTP (※9) | 2.5 | — | — | — | — | — |
| | | sulfur-phosphorous (※10) | — | 3.0 | — | — | — | — |
| | | alkyl acid phosphate | — | — | 1.0 | — | — | — |
| | | tricresyl phosphate | — | — | — | 2.0 | 1.0 | — |
| | | Total | 100.0 | 100.0 | 100.0 | 100.0 | 100.0 | 100.0 |
| kinematic viscosity at 40° C. of base oil ($mm^2/s$) | | | 100 | 100 | 100 | 100 | 100 | 100 |
| grease properties | | worked penetration | 293 | 290 | 289 | 285 | 286 | 293 |
| | | sulfur content (mass %) | 0.39 | 0.96 | 0.02 | 0.02 | 0.38 | 0.38 |
| | | sulfur content from extreme pressure agent (mass %) | 0.37 | 0.95 | 0 | 0 | 0.37 | 0.37 |
| | | phosphorous content (mass %) | 0.190 | 0.051 | 0.097 | 0.166 | 0.083 | 0.000 |
| load resistance | | high speed four-ball test (weld load) (N) | 1961 | 2452 | 1569 | 1569 | 1961 | 1961 |

TABLE 3-continued

| | | Comparative Example 8 | Comparative Example 9 | Comparative Example 10 | Comparative Example 11 | Comparative Example 12 | Comparative Example 13 |
|---|---|---|---|---|---|---|---|
| dust generation | dust generation test (piece/10 L) | 932 | 837 | 1541 | 615 | 1100 | 3059 |
| fretting property | fretting wear protection test (mg) | 25 | 35 | 32 | 26 | 28 | 26 |

(※1) poly-α-olefin, kinematic viscosity (40 degrees C.): 28.8 $mm^2/s$, kinematic viscosity (100 degrees C.): 5.6 $mm^2/s$, density (15 degrees C.): 0.826 $g/cm^3$
(※2) poly-α-olefin, kinematic viscosity (40 degrees C.): 63 $mm^2/s$, kinematic viscosity (100 degrees C.): 9.8 $mm^2/s$, density (15 degrees C.): 0.835 $g/cm^3$
(※3) poly-α-olefin, kinematic viscosity (40 degrees C.): 396 $mm^2/s$, kinematic viscosity (100 degrees C.): 14 $mm^2/s$, density (15 degrees C.): 0.849 $g/cm^3$
(※4) trimellitic acid-tri-2-ethylhexyl
(※5) an industrial stearic acid, (a mixture of stearic acid:palmitic acid:myristic acid:oleic acid = 64:30:5:1 (mass % ratio))
(※6) a reaction product of laurylamine and diphenylmethane-4,4'-diisocyanate
(※7) zinc diamyl dithiocarbamate
(※8) methylenebisdibutyl dithiocarbamate
(※9) zinc primary-di(2-ethylhexyl) dithiophosphate
(※10) Angramol 99 produced by Lubrizol Corporation In Tables 1 to 3, a sulfur content in the extreme pressure agent means a content ratio of sulfur derived from the extreme pressure agent relative to the whole grease composition. Accordingly, sulfur contents contained in the base oil or other additives are not included.

[Evaluation Method]

A shape, wear resistance and dust generation property were evaluated with respect to the grease compositions of Examples and Comparative Examples. An evaluation method is shown in detail below.

A worked penetration was measured by a method defined according to JIS K2220.7.5.

A sulfur content was measured by a method defined according to ASTM (American Society for Testing and Materials) D1552.

Fretting wear protection test: by a tester defined according to ASTM D4170 (an evaluation method of fretting-wear resistance of a lubricating grease), in which only a frequency was changed to 25 Hz, a measurement was carried out at 25 degrees C. of ambient temperature for 22 hours. A wear volume was calculated from a mass change of a bearing before and after the test.

High speed four-ball test: a weld load was measured by a method defined according to ASTM D2596. A load-carrying was evaluated.

Dust generation test: with a ball screw provided in a clean room defined according to ISO (International Organization for Standardization) 14644-1, a degree of dust generation from each of the grease compositions was evaluated. Specifically, a 20-g grease composition was filled entirely over a screw surface of a ball screw (diameter: 16 mm, lead: 8 mm). A 50-hour test was carried out under the conditions of a ball-nut speed of 100 mm/s and a stroke of 150 mm. Air was sucked from an intake port (sucking speed: 3 L/min) provided very near the screw at a middle of reciprocation. Fine particles of 0.3 μm or more were counted by a particle counter (manufactured by RION CO., LTD.: KC-03B) and defined as a dust generation number. A total counted number during the test time (50 hours) was shown in a unit of piece/10 L.

Figure 2:
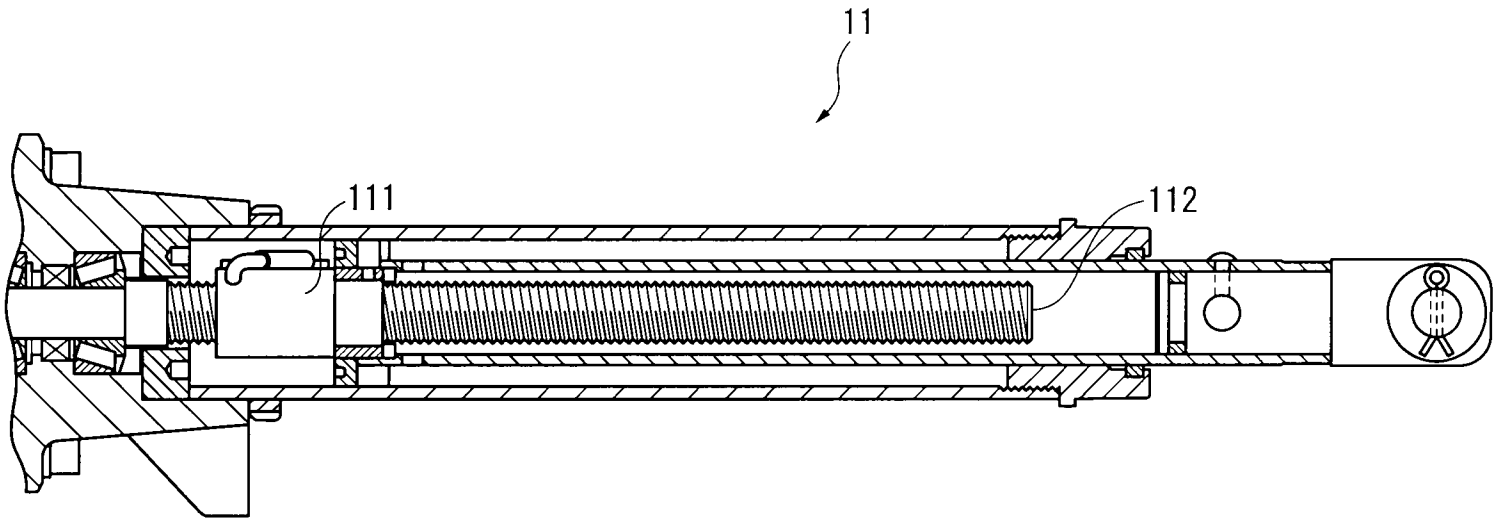
FIG. 2 is an enlarged view of a structure of a ball screw portion in the electrical cylinder of FIG. 1.

A ball screw load test was carried out by an electrical cylinder 10 shown in FIG. 1 (manufactured by TSUBAKI EMERSON CO.: Power cylinder LPTB500H4). FIG. 2 shows an enlarged view of a ball screw portion 11 of the electrical cylinder 10. The ball screw portion 11 includes a ball nut 111, a screw shaft 112 and a ball. A 40-g grease composition was filled over the screw shaft 112 (entirety of a screw surface). The screw shaft 112 was reciprocated 137000 times (movement distance: 100 km) under the conditions of a load: 5000N, a stroke: 365 mm, and a rod speed: 120 mm/s to evaluated whereby lubricity under such a high load condition. Specifically, after the test, the ball screw portion 11 was taken apart and damages of the screw, the nut and the ball were observed. This ball screw load test was carried out only on the grease compositions of Example 1 and Comparative Example 1.

[Evaluation Results]

Evaluation results are shown in Tables 1 to 3. Results of the ball screw load tests in Example 1 and Comparative Example 1 are as follows.

- screw conditions
  - Examples 1: no peeling,
  - Comparative Examples 1: presence of peelings (four lines)
- nut conditions
  - Examples 1: no wear
  - Comparative Examples 1: presence of wear
- ball conditions
  - Examples 1: no peeling
  - Comparative Examples 1: presence of peelings (20 pieces)

As apparently seen from Tables 1 to 3 and the results of the ball screw load tests, the grease compositions of Examples 1 to 7 each exhibit an excellent lubricity and a low dust generation.

On the other hand, in Comparative Example 1, the grease composition exhibits poor lubricity because an added amount of ZnDTC (contained as the extreme pressure agent) is too small. In Comparative Example 2, the grease composition has a lot of fretting wear because the worked penetration is too small (too hard). In Comparative Example 3, the grease composition generates a lot of dust because the worked penetration is, on the contrary, too large (too soft). In Comparative Example 4, the grease composition has a large fretting wear because the viscosity of the base oil is too high. In Comparative Example 5, the load resistance is deteriorated because the viscosity of the base oil is, on the contrary, too low. In Comparative Example 6, since the thickener is urea, dust generation is large. In Comparative Example 7, because of using the lithium soap including a hydroxyl group as the thickener, dust generation is large. In Comparative Example 8, since ZnDTP is used as the extreme pressure agent, dust generation is large. In Comparative Example 9, since the sulfur/phosphorous additive is used as the extreme pressure agent, dust generation is large. In Comparative Examples 10 and 11, since the sulfur/phosphorous additive is used as the extreme pressure agent, load resistance is insufficient. In Comparative Example 12, since both ZnDTC and the phosphorous additive are used, a phosphorous concentration eventually becomes too high, resulting in a large dust generation. In Comparative Example 13, since ester is used as the base oil, dust generation is large.

The invention claimed is:

1. A grease composition, comprising:

a poly-α-olefin having a kinematic viscosity at 40 degrees C. of 60 to 320 $mm^2/s$ in an amount of 50 mass % or more relative to the composition;

a thickener that is a lithium salt of a hydroxyl-free fatty acid having 10 to 22 carbon atoms; and an ashless dithiocarbamate and/or zinc dithiocarbamate in an amount of 0.1 to 1.5 mass % in terms of sulfur relative to the composition, wherein a phosphorous content in the grease composition is 0.05 mass % or less relative to the composition, and a worked penetration is in a range from 265 to 310.

2. The grease composition according to claim 1, wherein the lithium salt of the fatty acid is lithium stearate.

3. The grease composition according to claim 1, wherein the poly-α-olefin is a linear olefin oligomer.

4. The grease composition according to claim 1, wherein the composition is suitable for a linear motion machine in a clean environment.

5. The grease composition according to claim 4, wherein the linear motion machine comprises a rolling device comprising a ball screw as a mechanical element.

6. The grease composition according to claim 4, wherein the linear motion machine comprises a deceleration mechanism comprising a gear, and the gear comprises the composition.

7. The grease composition according to claim 1, further comprising at least one additive selected from the group consisting of an antioxidant, rust inhibitor, solid lubricant, filler, oiliness agent, and metal deactivator.

8. The grease composition according to claim 7, comprising at least one rust inhibitor selected from the group consisting of sodium nitrite, petroleum sulphonate, sorbitan monooleate, fatty acid soap, and an amine compound.

9. The grease composition according to claim 7, comprising at least one antioxidant selected from the group consisting of an amine antioxidant and a phenol antioxidant.

10. The grease composition according to claim 9, comprising the antioxidant in a ratio of from 0.05 to 2 mass %, based on the composition.

11. The grease composition according to claim 9, wherein the amine antioxidant is at least one selected from the group consisting of an alkylated diphenylamine, a phenyl-α-naphthylamine and an alkylated-α-naphthylamine.

12. The grease composition according to claim 9, wherein the phenol antioxidant is at least one selected from the group consisting of 2,6-di-t-butyl-4-methylphenol and 4,4'-methylenebis(2,6-di-t-butylphenol).

13. A linear motion machine comprising the grease composition according to claim 1.

14. The linear motion machine of claim 13, wherein the linear motion machine further comprises a rolling device comprising a ball screw.

15. The linear motion machine of claim 13, wherein the linear motion machine comprises a deceleration mechanism comprising a gear.

16. A lubricating method comprising applying the grease composition according to claim 1, to a linear motion machine, in a clean environment.

17. The method according to claim 16, wherein the linear motion machine comprises a rolling device comprising a ball screw as a mechanical element, and the grease composition is applied to the rolling device.

18. The method according to claim 16, wherein the linear motion machine comprises a deceleration mechanism comprising a gear, and the grease composition is applied to the gear.

19. The method according to claim 16, wherein the lithium salt of the fatty acid is lithium stearate.

20. The method according to claim 16, wherein the poly-α-olefin is a linear olefin oligomer.

* * * * *